US010418211B2

(12) United States Patent
Baron et al.

(10) Patent No.: US 10,418,211 B2
(45) Date of Patent: Sep. 17, 2019

(54) SWITCHING CONTACT OF A VACUUM INTERRUPTER COMPRISING SUPPORTING BODIES

(71) Applicant: Siemens Aktiengesellschaft, Munich (DE)

(72) Inventors: Lydia Baron, Dallgow-Doeberitz (DE); Frank Graskowski, Wandlitz (DE); Uwe Jahnke, Berlin (DE); Andreas Lawall, Berlin (DE); Ulf Schuemann, Dallgow-Doeberitz (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/759,617

(22) PCT Filed: Aug. 19, 2016

(86) PCT No.: PCT/EP2016/069669

§ 371 (c)(1),
(2) Date: Mar. 13, 2018

(87) PCT Pub. No.: WO2017/045862

PCT Pub. Date: Mar. 23, 2017

(65) Prior Publication Data

US 2019/0043681 A1 Feb. 7, 2019

(30) Foreign Application Priority Data

Sep. 15, 2015 (DE) ..... 10 2015 217 647

(51) Int. Cl.
*H01H 33/664* (2006.01)

(52) U.S. Cl.
CPC ..... *H01H 33/664* (2013.01); *H01H 33/6644* (2013.01); *H01H 2229/04* (2013.01)

(58) Field of Classification Search
CPC ..... H01H 33/664; H01H 33/6641; H01H 33/6642; H01H 33/6644; H01H 33/6645; H01H 2033/6648; H01H 33/66
(Continued)

(56) References Cited

U.S. PATENT DOCUMENTS 4,532,391 A 7/1985 Bernt
4,588,879 A * 5/1986 Noda ..... H01H 33/6644 218/127

(Continued)

FOREIGN PATENT DOCUMENTS

CN 102751131 A 10/2012
DE 3231593 A1 3/1984

(Continued)

OTHER PUBLICATIONS

Chinese Office Action dated Oct. 8, 2018.
Russian Office Action dated Dec. 14, 2018.
Russian Office Action dated Mar. 20, 2019.

*Primary Examiner* — Edwin A. Leon
*Assistant Examiner* — William A Bolton
(74) *Attorney, Agent, or Firm* — Harness, Dickey & Pierce, P.L.C.

(57) ABSTRACT

A switching contact, of a vacuum interrupter including support bodies, includes an additional support body which has the shape of a truncated cone or of a hollow truncated cone or of a partially hollow truncated cone. The additional support body is offset from a first location or region on the bottom of the contact carrier, located in the notional extension of the contact rod and inside the contact carrier, to a second location or region, located on the side of the contact plate facing the contact carrier and on the outer edge of the contact plate in relation to the first region.

19 Claims, 3 Drawing Sheets

(58) Field of Classification Search
USPC ..... 218/118, 123, 127–130, 146
See application file for complete search history.

(56) References Cited

U.S. PATENT DOCUMENTS

| | | | | | |
|---|---|---|---|---|---|
| 4,620,074 | A | | 10/1986 | Paul et al. | |
| 4,675,483 | A | * | 6/1987 | Gebel | H01H 33/6642 218/129 |
| 5,064,976 | A | | 11/1991 | Bialkowski | |
| 5,099,093 | A | * | 3/1992 | Schels | H01H 33/6642 218/128 |
| 5,777,287 | A | * | 7/1998 | Mayo | H01H 33/6642 200/275 |
| 5,804,788 | A | * | 9/1998 | Smith | H01H 33/6644 218/128 |
| 6,479,779 | B1 | * | 11/2002 | Falkingham | H01H 33/6642 218/123 |
| 8,288,674 | B2 | * | 10/2012 | Kantas | H01H 33/6642 218/118 |
| 8,302,303 | B2 | * | 11/2012 | Gentsch | H01H 33/664 29/840 |
| 2003/0080093 | A1 | | 5/2003 | Matsui et al. | |
| 2004/0050819 | A1 | | 3/2004 | Matsui et al. | |
| 2013/0062316 | A1 | | 3/2013 | Renz et al. | |

FOREIGN PATENT DOCUMENTS

| | | | |
|---|---|---|---|
| DE | 3507317 | A1 | 9/1986 |
| DE | 3828556 | C1 | 3/1990 |
| DE | 3840825 | A1 | 8/1990 |
| DE | 9206596 | U1 | 7/1992 |
| EP | 0155376 | B1 | 6/1987 |
| EP | 0104384 | B1 | 11/1987 |
| EP | 0410049 | A1 | 1/1991 |
| EP | 1294004 | A1 | 3/2003 |
| RU | 2510084 | C1 | 3/2014 |
| RU | 2510094 | C2 | 3/2014 |
| WO | WO 03096364 | A1 | 11/2003 |
| WO | WO 2006003114 | A2 | 1/2006 |

* cited by examiner

SWITCHING CONTACT OF A VACUUM INTERRUPTER COMPRISING SUPPORTING BODIES

PRIORITY STATEMENT

This application is the national phase under 35 U.S.C. § 371 of PCT International Application No. PCT/EP2016/069669 which has an International filing date of Aug. 19, 2016, which designated the United States of America and which claims priority to German patent application number DE 102015217647.9 filed Sep. 15, 2015, the entire contents of which are hereby incorporated herein by reference.

FIELD

An embodiment of invention generally relates to a switching contact for a vacuum interrupter, in particular to a switching contact including a supporting body.

BACKGROUND

Switching contacts for vacuum interrupters, which switching contacts include a switching contact carrier and a contact plate or contact disk, are known from the prior art. In particular, it is known that the switching contact carrier has a coil segment for generating a magnetic field, wherein this coil segment is formed by making slots in the lateral surround of a pot-like contact carrier.

Contact arrangements of this kind are known from EP 0104384 B1 and EP 0155376 B1.

Either a radial or an axial magnetic field is generated depending on the orientation of the coil segments of contact arrangements of this kind in relation to one another.

Arrangements of this kind with an axial magnetic field in particular are relevant for high-voltage applications. The slot arrangements of the coil segments of the contact carriers in the two contacts are oriented in the same direction for the purpose of generating an axial magnetic field.

In order to prevent the contact disks from settling, that is to say sinking, in switching contacts for vacuum interrupters, it is known from the prior art to provide supporting bodies.

For example, DE 3231593 A1 discloses a supporting body of this kind for a switching contact.

Furthermore, it is known from WO 2006003114 A2 that a supporting body can also be provided on the outer circumference of the switching contact carrier. Although a structure of this kind helps to improve the performance, it does not provide any protection against sinking of the contact disk.

SUMMARY

At least one embodiment of the invention reduces or even eliminates one or more of the disadvantages of the prior art and/or prevents both untwisting of the coil and also sinking of the contact disk.

In one embodiment, the switching contact for a vacuum switch including a contact bar comprises:

a contact carrier which is connected to the contact bar, a contact disk which is connected to the contact carrier, and a supporting body which extends from the contact disk in the direction of the contact bar and/or of the contact carrier in such a way that sinking of the contact disk is prevented and/or reduced, wherein the contact bar is electrically conductively connected to the contact carrier, wherein the contact disk is electrically conductively connected to the contact carrier, wherein the supporting body is held in the position between the contact disk and the contact carrier or an additional supporting body either by the shaping of the contact disk and/or of the contact carrier and/or of the additional supporting body and/or by soldering, and wherein the switching contact has an additional supporting body which has the shape of a truncated cone or of a hollow truncated cone or of a partially hollow truncated cone, the additional supporting body extends from a first location or first region on the base of the contact carrier, which first location or first region is located in the imaginary extension of the contact bar and within the contact carrier, to a second location or second region which is located on that side of the contact disk which faces the contact carrier and is offset in relation to the first location or first region at the outer edge of the contact disk, wherein the additional supporting body is connected to the contact disk, and wherein the additional supporting body is connected to the contact carrier.

At least one embodiment is directed to a vacuum interrupter including one or two switching contacts of at least one embodiment.

BRIEF DESCRIPTION OF THE DRAWINGS

The invention will be described in more detail below within the scope of an example embodiment with reference to figures, in which.

DETAILED DESCRIPTION OF THE EXAMPLE EMBODIMENTS

Figure 1:
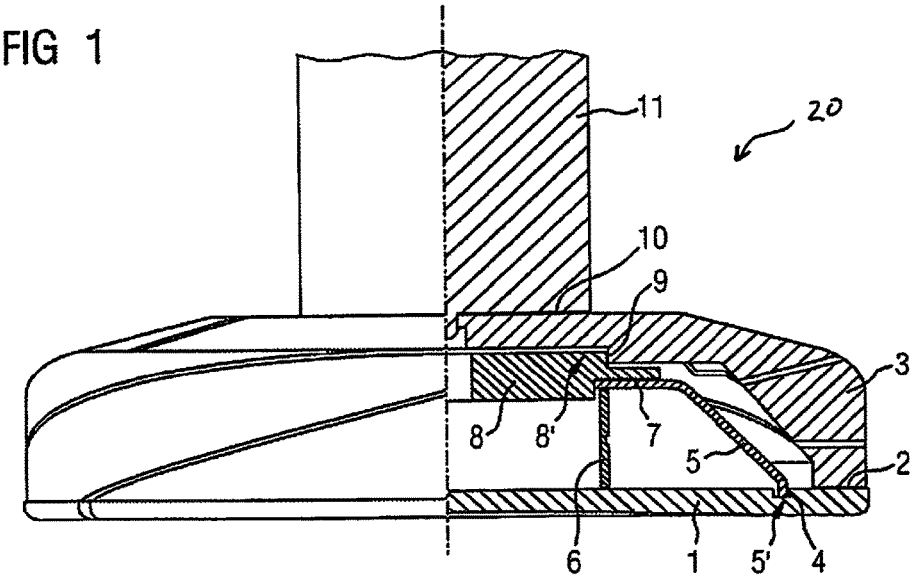
FIG. 1 shows a switching contact in side view and in section.

In one embodiment, the switching contact for a vacuum switch including a contact bar comprises:

a contact carrier which is connected to the contact bar, a contact disk which is connected to the contact carrier, and a supporting body which extends from the contact disk in the direction of the contact bar and/or of the contact carrier in such a way that sinking of the contact disk is prevented and/or reduced, wherein the contact bar is electrically conductively connected to the contact carrier, wherein the contact disk is electrically conductively connected to the contact carrier, wherein the supporting body is held in the position between the contact disk and the contact carrier or an additional supporting body either by the shaping of the contact disk and/or of the contact carrier and/or of the additional supporting body and/or by soldering, and wherein the switching contact has an additional supporting body which has the shape of a truncated cone or of a hollow truncated cone or of a partially hollow truncated cone, the additional supporting body extends from a first location or first region on the base of the contact carrier, which first location or first region is located in the imaginary extension of the contact bar and within the contact carrier, to a second location or second region which is located on that side of the contact disk which faces the contact carrier and is offset in relation to the first location or first region at the outer edge of the contact disk, wherein the additional supporting body is connected to the contact disk, and wherein the additional supporting body is connected to the contact carrier.

In at least one embodiment, the contact carrier includes a U-shaped rotation body, that is to say a body which acquires a shape similar to the U owing to the rotation, also known as a pot-like body. This pot-like body is closed on three sides and open on one side and has an outer face and an inner face. The inner face and the outer face of the side which is situated opposite the open side is called the base.

The contact bar is connected to the outside of this base of the contact carrier. At least one portion of the inner face of the base of the contact carrier is connected to at least one part of the additional supporting body or at least one part of the first additional supporting body.

In at least one embodiment, the supporting body and/or additional supporting body are/is formed from a material with a lower conductivity than copper and with a greater mechanical stability than copper, in particular it is preferred that the supporting body and/or additional supporting body are/is formed from stainless steel.

In at least one embodiment, the contact bar is electrically conductively connected to the contact carrier by soldering, and/or the contact disk is electrically conductively connected to the contact carrier by soldering, and/or the additional supporting body is connected to the contact disk by soldering, and/or the additional supporting body is connected to the contact carrier by soldering.

In at least one embodiment, the additional supporting body is of two-part design, and the truncated cone or hollow truncated cone or partially hollow truncated cone is formed by a first additional supporting body which is soldered to the contact carrier, and a second additional supporting body which is soldered to the contact disk, wherein the first additional supporting body and the second additional supporting body are soldered to one another.

The truncated cone or hollow truncated cone or partially hollow truncated cone which is formed in this way forms a rotationally symmetrical body or rotation body.

In at least one embodiment, the material thickness of the first additional supporting body is thicker than the material thickness of the second additional supporting body. This satisfies the different mechanical and electromagnetic requirements. The two-part design is advantageous, amongst other things, in respect of production of the additional supporting body.

In at least one embodiment, the additional supporting body is of integral design, wherein it is further preferred that the material thickness of the part of the additional supporting body which is located on the base of the contact carrier in the imaginary extension of the contact bar is thicker than the material thickness of the part of the additional supporting body which extends from that side of the contact disk which faces the contact carrier in the direction of the base of the contact carrier. This satisfies the different mechanical and electromagnetic requirements. The integral design is advantageous, amongst other things, in respect of the assembly of the switching contact.

In at least one embodiment, the soldering foils and/or soldering rings are provided in order to form the solder connection between the contact disk and the additional supporting body, the contact disk and the contact carrier, the first additional supporting body and the second additional supporting body, the additional supporting body and the contact carrier, and the contact carrier and the contact bar.

If the additional supporting body is of integral design, it goes without saying that a solder connection between a first additional supporting body and a second additional supporting body is not required and accordingly is not provided either.

In at least one embodiment, the soldering is performed by closure soldering in one step.

In at least one embodiment, the closure soldering is performed under vacuum conditions, in particular in a vacuum furnace.

A vacuum interrupter comprising one or two switching contacts of the above kind is also included in at least one embodiment.

FIG. 1 shows a possible example embodiment of a switching contact 20, wherein the left-hand side shows a side view of and the right-hand side shows a section through the switching contact 20.

The sectional side shows the contact bar 11 which is connected to the contact carrier 3, wherein the connection is preferably established via soldering foil or a soldering ring 10.

The contact disk 1 is arranged on that side of the contact carrier 3 which is situated opposite the contact bar, and is preferably connected to the contact carrier 3 by soldering foil or a soldering ring 2.

Furthermore, FIG. 1 shows a two-part additional supporting body 5, 8 which includes a first additional supporting body 8 and a second additional supporting body 5. An integral design is not shown, but would be constructed in an analogous manner except that the additional supporting body 5, 8 does not include a first additional supporting body 8 and a second additional supporting body 5 in the case of an integral construction, but rather includes a part, preferably a rotary or cast part, in the form of a truncated cone or hollow truncated cone or partially hollow truncated cone.

Irrespective of the integral or two-part design, the section in FIG. 1 shows that a first additional supporting body which is rectangular in section and is provided with cutouts adjoins at least a portion of the inner face of the base of the contact carrier 3, the first additional supporting body tapering in the direction of the edge of the contact carrier 3 and adjoining either the second additional supporting body or, not shown, the additional supporting body extending further in the direction of the contact disk 1.

In the case of the second additional supporting body 5 shown here, this second additional supporting body 5 extends from a projection in the first additional supporting body 8 initially parallel to the base of the contact carrier 3 and then bends in such a way that it extends in a straight line or in a bent manner to the contact disk 1. In this case, it is preferred that the second additional supporting body 5 has a lower thickness than the first additional supporting body 8.

It is also preferred that, as shown in FIG. 1, the location 5', at which the second additional supporting body 5 is connected to the contact disk 1, is situated closer to the location where the contact carrier 3 is connected to the contact disk 1 than in the imaginary extension of the contact bar. It should be noted that the above description relates to the section, and the described shapes form a body due to rotation.

The first additional supporting body 8 and the second additional supporting body 5 are preferably soldered to one another via soldering foil or soldering ring 7.

The first additional supporting body 8 is positioned at the first location or in the first region 8' below the contact bar 11, that is to say in the imaginary extension of the contact bar, on the inner face of the contact carrier 3 and is preferably soldered to the contact carrier via soldering foil or soldering ring 9.

The second additional supporting body 5 is soldered to the contact disk 1 at the location 5' or in the region 5', wherein the second additional supporting body 5 is fastened to that side of the contact disk 1 which points in the direction of the contact carrier 3.

FIG. 1 furthermore shows that the region 5' is offset in relation to the edge of the contact disk 1 in comparison to the region 8'.

Figure 2:
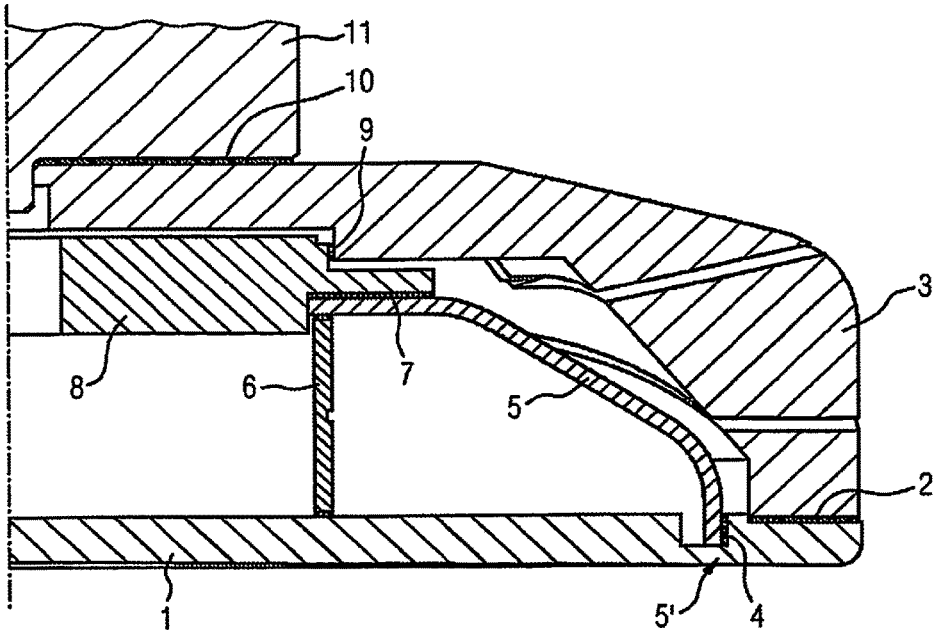
FIG. 2 shows a sectional view through a switching contact.

FIG. 2 shows the section from FIG. 1 on an enlarged scale. The figure also shows that the contact bar 11 is soldered to the contact carrier 3 via soldering foil or a soldering ring 10.

In this two-part design, the additional supporting element 5, 8 is formed by the first additional supporting element 8 and the second additional supporting element 5, wherein the additional supporting elements are soldered via soldering foil or soldering ring 7.

In this example embodiment, the supporting body 6 is arranged between the additional supporting body 5 and the contact disk 1 and is preferably soldered to the additional supporting body and contact disk.

The soldering foil and, respectively, the soldering ring 9, 4 respectively connect the contact carrier 3 to the first additional supporting body 8 and the second additional supporting body 5 to the contact disk 1.

Figure 3:
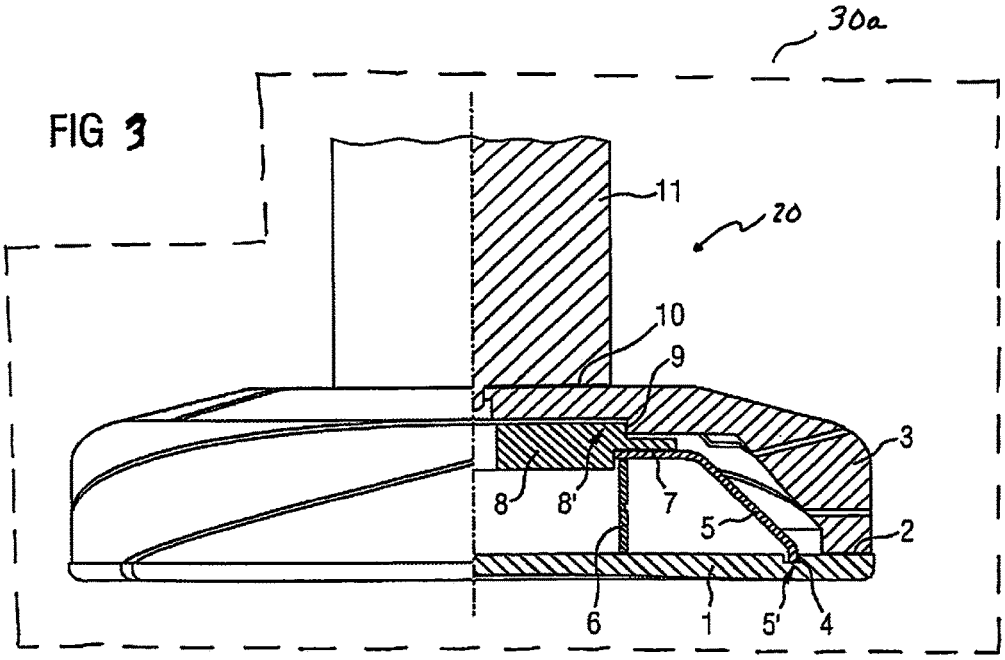
FIG. 3 shows a vacuum interrupter including one switching contact of the embodiment of FIG. 1.

FIG. 3 shows a vacuum interrupter 30*a* including one switching contact 20*a* of the embodiment of FIG. 1.

Figure 4:
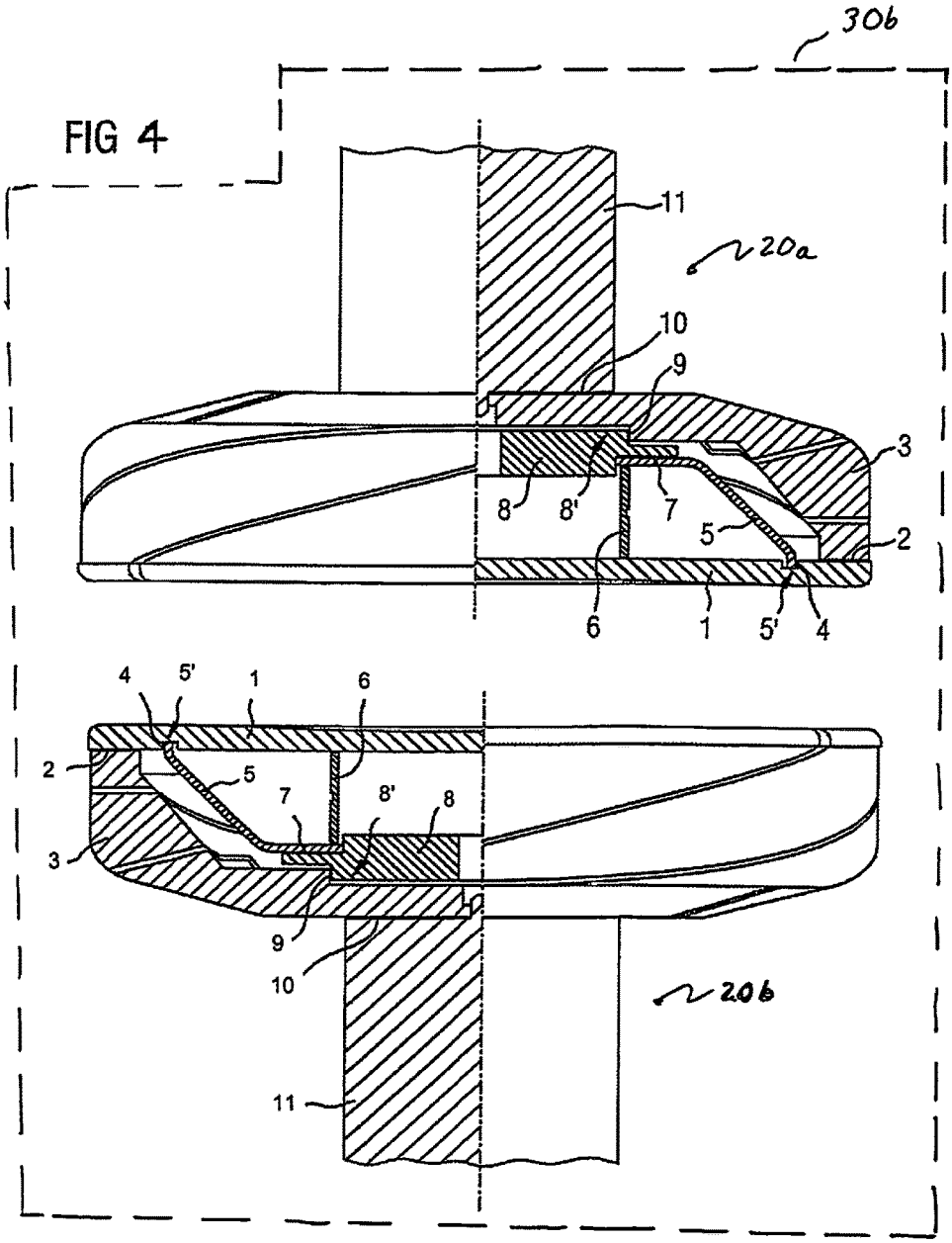
FIG. 4 shows a vacuum interrupter including two switching contacts of the embodiment of FIG. 1.

FIG. 4 shows a vacuum interrupter 30*b* including two switching contacts 20*a* and 20*b* of the embodiment of FIG. 1.

LIST OF REFERENCE SYMBOLS

1 Contact disk
2 Soldering foil and/or soldering ring
3 Contact carrier
4 Soldering foil and/or soldering ring
5 Second additional supporting body
5' Second location
6 Supporting body
7 Soldering foil and/or soldering ring
8 First additional supporting body
8' First location
9 Soldering foil and/or soldering ring
10 Soldering foil and/or soldering ring
11 Contact bar
20*a* switching contact
20*b* switching contact
30*a* vacuum interrupter
30*b* vacuum interrupter

The invention claimed is:

1. A switching contact for a vacuum switch, comprising:
a contact bar;
a contact carrier, electrically conductively connected to the contact bar;
a contact disk, electrically conductively connected to the contact carrier;
a supporting body, extending from the contact disk in a direction of at least one of the contact bar and the contact carrier such that sinking of the contact disk is at least one of prevented and reduced, the supporting body being held in a position, between the contact disk and the contact carrier or an additional supporting body, at least one of
by shaping of at least one of the contact disk, the contact carrier and the additional supporting body and
by soldering; and
the additional supporting body, having a shape of a truncated cone or of a hollow truncated cone or of a partially hollow truncated cone, the additional supporting body extending from a first location, on a base of the contact carrier located in an imaginary extension of the contact bar and within the contact carrier, to a second location, located on a side of the contact disk facing the contact carrier and offset in relation to the first location to an outer edge of the contact disk, the additional supporting body being connected to the contact disk and being connected to the contact carrier, wherein the additional supporting body is of two-part design including a first additional supporting body and a second additional supporting body, and the truncated cone or hollow truncated cone or partially hollow truncated cone is formed by
the first additional supporting body soldered to the contact carrier, and
the second additional supporting body soldered to the contact disk, wherein the first additional supporting body and the second additional supporting body are soldered to one another.

2. The switching contact of claim 1, wherein at least one of
the contact bar is electrically conductively connected to the contact carrier by soldering;
the contact disk is electrically conductively connected to the contact carrier by soldering;
the additional supporting body is connected to the contact disk by soldering; and
the additional supporting body is connected to the contact carrier by soldering.

3. The switching contact of claim 2, wherein the soldering is performed by closure soldering in one step.

4. The switching contact of claim 2, wherein the additional supporting body is of two-part design including a first additional supporting body and a second additional supporting body, and the truncated cone or hollow truncated cone or partially hollow truncated cone is formed by
the first additional supporting body soldered to the contact carrier, and
the second additional supporting body soldered to the contact disk, wherein the first additional supporting body and the second additional supporting body are soldered to one another.

5. The switching contact as claimed in claim 4, wherein the additional supporting body is of two-part integral design including the first additional supporting body and the second additional supporting body.

6. The switching contact of claim 4, wherein at least one of soldering foils and soldering rings are provided to form solder connections between at least one of the contact disk and the additional supporting body, the contact disk and the contact carrier, the first additional supporting body and the second additional supporting body, the additional supporting body and the contact carrier, and the contact carrier and the contact bar.

7. The switching contact as claimed in claim 2, wherein the additional supporting body is of integral design.

8. The switching contact of claim 2, wherein at least one of soldering foils and soldering rings are provided to form solder connections between at least one of the contact disk and the additional supporting body, the contact disk and the contact carrier, the additional supporting body and the contact carrier, and the contact carrier and the contact bar.

9. The switching contact of claim 8, wherein the soldering is performed by closure soldering in one step.

10. A vacuum interrupter comprising the switching contact of claim 2.

11. The switching contact as claimed in claim 1, wherein the additional supporting body is of integral design.

12. A vacuum interrupter comprising the switching contact of claim 11.

13. The switching contact of claim 1, wherein at least one of soldering foils and soldering rings are provided to form solder connections between the contact disk and the additional supporting body, the contact disk and the contact carrier, the first additional supporting body and the second additional supporting body, the additional supporting body and the contact carrier, and the contact carrier and the contact bar.

14. The switching contact of claim 13, wherein the soldering is performed by closure soldering in one step.

15. A vacuum interrupter comprising the switching contact of claim 13.

16. A vacuum interrupter comprising the switching contact of claim 1.

17. The switching contact as claimed in claim 1, wherein the additional supporting body is of two-part integral design including the first additional supporting body and the second additional supporting body.

18. The switching contact of claim 1, wherein at least one of soldering foils and soldering rings are provided to form solder connections between the contact disk and the additional supporting body, the contact disk and the contact carrier, the additional supporting body and the contact carrier, and the contact carrier and the contact bar.

19. A vacuum interrupter comprising at least two of the switching contacts of claim 1.

* * * * *